US007234779B2

(12) United States Patent
Bedford et al.

(10) Patent No.: US 7,234,779 B2
(45) Date of Patent: Jun. 26, 2007

(54) ARMREST WITH HEIGHT ADJUSTMENT MECHANISM

(75) Inventors: Adam C. Bedford, Rockford, MI (US); David A. Bodnar, Ada, MI (US); Gary Lee Karsten, Wyoming, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 11/361,622

(22) Filed: Feb. 24, 2006

(65) Prior Publication Data

US 2006/0226691 A1 Oct. 12, 2006

Related U.S. Application Data

(60) Provisional application No. 60/669,536, filed on Apr. 8, 2005.

(51) Int. Cl.
*A47C 7/54* (2006.01)

(52) U.S. Cl. ..... 297/411.36; 297/411.35; 297/344.16

(58) Field of Classification Search ..... 297/411.36, 297/411.35, 344.18; 248/118.3, 406.1, 404, 248/354.1

See application file for complete search history.

(56) References Cited

U.S. PATENT DOCUMENTS

| | | | |
|---|---|---|---|
| 159,243 | A | 1/1875 | Woodward |
| RE7,687 | E | 5/1877 | Morrison |
| RE19,721 | E | 10/1935 | Genung |
| 2,501,976 | A | 3/1950 | Vitek |
| 2,549,902 | A | 4/1951 | Hibbard et al. |
| 2,584,015 | A | 1/1952 | Hawes |
| 4,493,469 | A | 1/1985 | Holobaugh |
| 4,576,351 | A | 3/1986 | Brink |
| 4,613,106 | A | 9/1986 | Tornero |
| 4,750,701 | A | 6/1988 | Folson et al. |
| 4,752,178 | A | 6/1988 | Greenhill |
| 4,860,987 | A | 8/1989 | Werner |
| 4,901,987 | A | 2/1990 | Greenhill et al. |
| 4,968,094 | A | 11/1990 | Froyland et al. |

(Continued)

FOREIGN PATENT DOCUMENTS

| | | |
|---|---|---|
| DE | 10142370 | 3/2003 |

(Continued)

*Primary Examiner*—David Dunn
*Assistant Examiner*—Sarah B. McPartlin
(74) *Attorney, Agent, or Firm*—Price, Heneveld, Cooper, DeWitt & Litton LLP

(57) ABSTRACT

An armrest includes an armrest support and a subassembly supported thereon for vertical adjustment by a height adjustment device having a rotatable high-lead-angle threaded shaft, a mating nut, and a trigger. The shaft member is rotatable upon a vertical force being placed on the subassembly, and the trigger engages the shaft to prevent rotation and fix a selected height position. The subassembly includes a housing, an armrest cap, and a pair of swing arms pivoted to each of the housing and cap for adjustably supporting the armrest cap for rotational and translational horizontal movement. Horizontal adjustment is controlled by choice of materials, a frictional wave spring and dampener. Optionally, the armrest cap includes a keyhole slot and one of the links includes a configured protrusion shaped to selectively linearly slide along a long part of the slot . . . or rotate in the circular end of the keyhole slot.

23 Claims, 12 Drawing Sheets

U.S. PATENT DOCUMENTS 5,284,314 A 2/1994 Misaras et al.
5,380,065 A 1/1995 Rohrer
5,407,249 A 4/1995 Bonutti
5,439,267 A 8/1995 Peterson et al.
5,439,268 A 8/1995 Dozsa-Farkas
5,478,137 A 12/1995 Olson et al.
5,484,187 A 1/1996 Doerner et al.
5,586,811 A 12/1996 Tornero
5,599,067 A * 2/1997 Schuelke et al. ..... 297/411.35
5,639,074 A 6/1997 Greenhill et al.
5,641,203 A 6/1997 Van De Riet et al.
5,651,586 A 7/1997 Groth
5,660,442 A 8/1997 Tornero
5,676,483 A 10/1997 Koubek
5,749,628 A 5/1998 Synder et al.
5,752,683 A 5/1998 Novis et al.
5,826,847 A * 10/1998 Warner et al. ..... 248/354.1
5,876,097 A 3/1999 Cao
5,895,095 A 4/1999 Chen
5,927,811 A 7/1999 Tseng
5,931,537 A * 8/1999 Gollin et al. ..... 297/411.36
5,971,484 A 10/1999 Lamart et al.
5,975,640 A 11/1999 Chen
6,017,091 A 1/2000 Cao
6,022,079 A 2/2000 Bergsten et al.
6,045,191 A 4/2000 Piretti
6,053,578 A 4/2000 van Hekken et al.
6,059,366 A 5/2000 Hu
6,062,646 A 5/2000 Bock
6,076,891 A 6/2000 Bernhardt
6,076,892 A 6/2000 van Hekken et al.
6,142,570 A 11/2000 Bergsten et al.
6,168,237 B1 1/2001 Lamart et al.
6,176,550 B1 1/2001 Lamart et al.
6,203,109 B1 3/2001 Bergsten et al.
6,213,556 B1 4/2001 Chen
6,250,618 B1 6/2001 Greenhill
6,254,071 B1 7/2001 Greenhill
6,302,486 B1 10/2001 Lamart et al.
6,343,839 B1 2/2002 Simons, Jr. et al.
6,394,553 B1 * 5/2002 McAllister et al. .... 297/411.36
6,460,932 B1 10/2002 Kopish et al.
6,502,904 B1 1/2003 Hansen
6,540,300 B2 4/2003 Piretti
6,588,847 B2 7/2003 Murakami
6,619,746 B2 * 9/2003 Roslund et al. ..... 297/411.36
6,659,561 B1 12/2003 Lee
6,758,465 B1 7/2004 Greenhill et al.
6,773,072 B2 * 8/2004 Phillips et al. ..... 297/411.35
6,799,803 B1 10/2004 Lee et al.
6,802,566 B2 10/2004 Prince et al.
6,908,158 B2 6/2005 Willette et al.
6,916,068 B2 7/2005 Kitamura et al.
6,948,774 B2 9/2005 Maier et al.
2002/0043862 A1 4/2002 Piretti
2002/0070598 A1 6/2002 Perl
2003/0025378 A1 2/2003 Lin
2003/0030317 A1 2/2003 Chen
2004/0130200 A1 7/2004 Willette et al.
2005/0146192 A1 7/2005 Trego et al.
2005/0189807 A1 9/2005 Norman et al.

FOREIGN PATENT DOCUMENTS

DE 10142371 A1 3/2003
EP 0958765 A2 5/1989
EP 0809957 A2 2/1997
EP 1057428 A1 6/1999
EP 1106110 A1 11/2000
EP 1161903 A2 5/2001
EP 1284115 A2 8/2002
EP 1287765 A1 8/2002
EP 1405582 B1 10/2002
EP 1410736 A1 9/2003
EP 1457140 A2 3/2004
JP 11-004727 1/1999
JP 1137370 A 5/1999
JP 2004188072 A 7/2004
NL C1018820 5/2003

* cited by examiner

ARMREST WITH HEIGHT ADJUSTMENT MECHANISM

CROSS REFERENCE TO RELATED APPLICATIONS

This application claims benefit under 35 USC §119(e) of provisional application Ser. No. 60/669,536, filed Apr. 8, 2005, entitled ADJUSTABLE ARMREST WITH MOTION CONTROL, which is incorporated herein by reference. The present application is further related to application Ser. No. 11/361,779, filed on even date herewith, entitled, ADJUSTABLE ARMREST WITH MOTION CONTROL which is also incorporated herein by reference, and which also claims benefit of the provisional application Ser. No. 60/669,536.

BACKGROUND

The present application relates to an adjustable armrest adapted to adjust in multiple directions with a smooth and elegant feel.

Armrests are often made to be adjustable in multiple directions, such as laterally (rotationally and/or translationally), longitudinally (fore/aft), and vertically. Unfortunately, adjustable armrests tend to be more expensive since they require mating movable components permitting the adjustment, and further they require locking mechanisms to hold the adjustments. Considerable design effort and manufacturing care is required to prevent the mating components from being loose and sloppy, or from being too tight, both of which result in users believing that the armrests are cheap and poorly designed. Notably, a smooth "non-loose" feel can be difficult and expensive to achieve. It requires tight tolerances that are closely controlled and also requires lubricious bearing surfaces (but not "too" lubricious), each of which increases costs. Further, even if initially tight and acceptable, components wear, resulting in the armrest becoming loose and "sloppy." Greases and lubricants are not necessarily an acceptable long-term solution because they may rub off and/or become ineffective over time, causing friction to increase to a point where the adjustment movement drags unacceptably. Another problem occurs when the friction becomes inconsistent, such that it provides an irregular or "scratchy" feel during adjustment.

Accordingly, an adjustable armrest is desired having the aforementioned advantages and solving the aforementioned problems. In particular, adjustment mechanisms are desired that are robust, low-cost, easy to assemble, and long-lasting, and that are adjustable with a smooth and elegant motion.

SUMMARY OF THE INVENTION

In one aspect of the present invention, an armrest for a seating unit includes an armrest stalk having a first vertical section, an armrest assembly having a second vertical section telescopingly engaging the first vertical section for vertical adjustment; and a height control including a spiral threaded shaft member on one of the first and second vertical sections, a mating nut member on the other of the first and second vertical sections that operably engages the shaft member, and a trigger. One of the threaded shaft member and the nut member is rotatable upon a vertical force being placed on the armrest assembly, and the trigger is positioned to selectively engage the one member to prevent rotation after vertical adjustment to thus fix a selected height position.

Another aspect of the present invention concerns an armrest for a seating unit that includes an armrest stalk having a vertical section and an armrest component that vertically engages the vertical section for vertical adjustment. An improvement comprises a height control including a spiral threaded shaft member on one of the vertical section and the armrest component, a mating nut member on the other of the vertical section and the armrest component that operably engages the shaft member, and a trigger. One of the threaded shaft member and the nut member are rotatable upon a vertical force being placed on the armrest component, and the trigger is positioned to selectively engage the one member to prevent rotation after vertical adjustment to thus fix a selected height position.

In another aspect of the present invention, an adjustable device includes a stalk for supporting a device and having a first vertical section. A subassembly has a second vertical section that engages the first vertical section for translational telescoping adjustment, with one of the first and second vertical sections including a tubular section that telescopingly slidingly engages the other of the first and second vertical sections. An adjustment control device includes a spiral shaft member in one of the first and second vertical sections, a mating member on the other of the first and second vertical sections that operably engages the shaft member, and a trigger; one of the shaft member and the nut member being rotatable upon a vertical force being placed on the subassembly, and the trigger being positioned to selectively engage the one member to prevent rotation after vertical adjustment to thus fix a selected height position.

These and other aspects, objects, and features of the present invention will be understood and appreciated by those skilled in the art upon studying the following specification, claims, and appended drawings.

DETAILED DESCRIPTION OF PREFERRED EMBODIMENT

Figure 1:
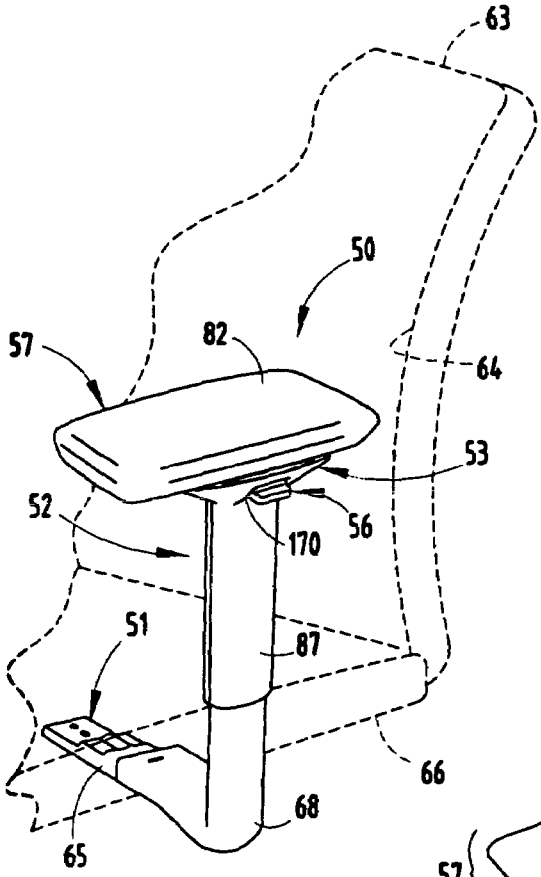
FIGS. 1–3 are perspective, rear and side views of an armrest embodying the present invention, the armrest being longitudinally adjustable, laterally adjustable (both rotationally and translationally) and also vertically adjustable.
Figure 2:
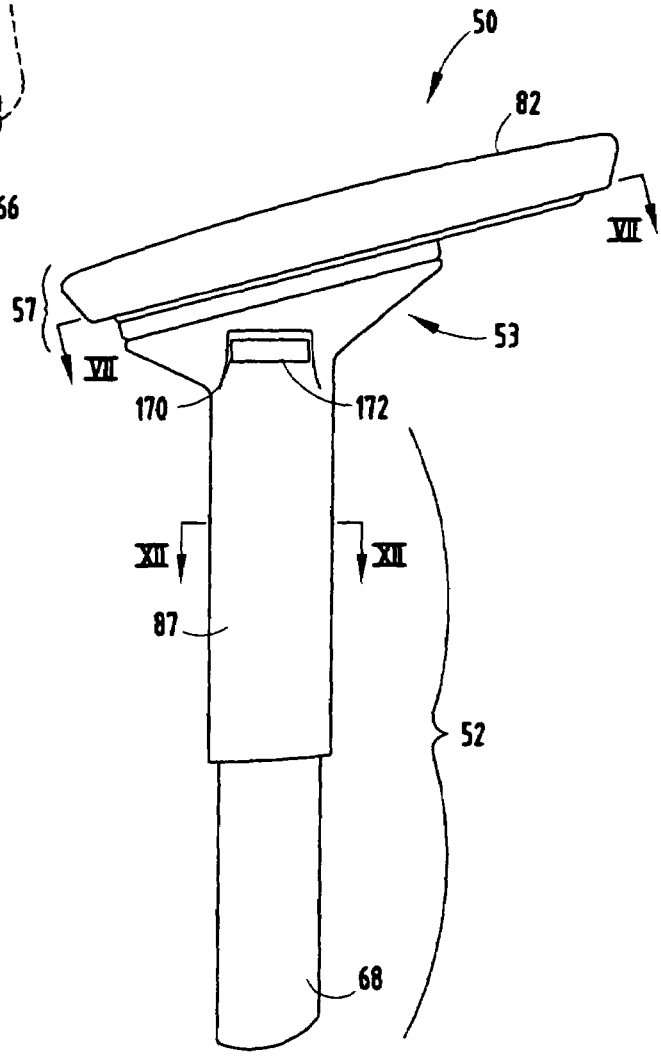
Figure 4:
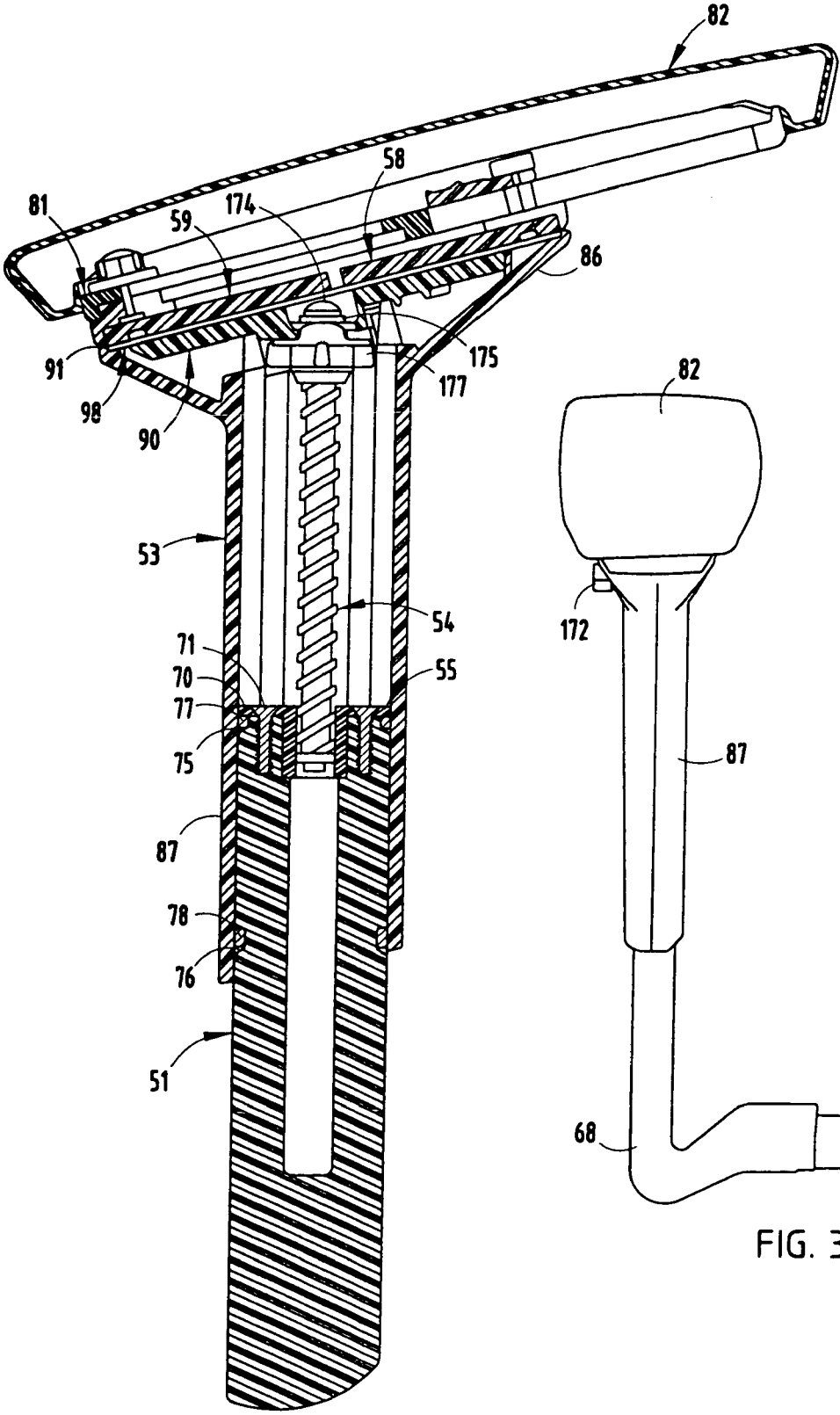
FIG. 4 is an enlarged view of an upper portion of FIG. 3.
Figure 3:
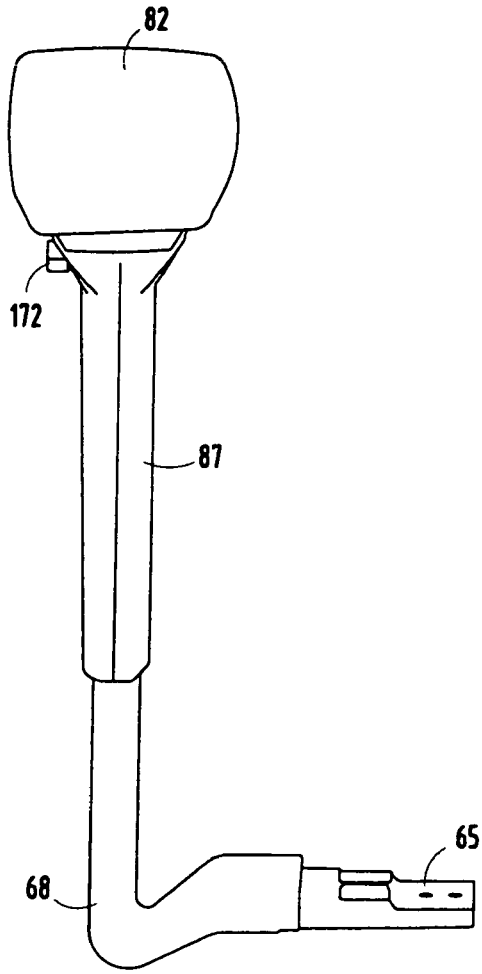

An armrest 50 (FIG. 1) includes a support stalk 51 adapted for attachment under a chair seat, and an adjustable armrest subassembly 52 with a support housing 53 slidably supported on the stalk 51 for vertical adjustment by a lockable height adjustment device. The height adjustment device includes a spiral threaded shaft 54 (FIG. 3) rotatably supported by the housing 53, a mating nut 55 on the stalk 51, and a locking trigger 56. The shaft 54 is rotatable to permit vertical adjustment upon a vertical force being placed on the subassembly when the trigger 56 is disengaged, but the trigger 56 is biased to engage the shaft 54 to prevent rotation and thus selectively fix the subassembly in a vertically-adjusted position. The subassembly includes an armrest cap 57 (FIG. 5) adjustably supported on the housing 53 by a pair of swing arms 58 and 59 in a four-bar sliding linkage arrangement that allows lateral (rotational and translational) movement and also that allows longitudinal horizontal movement to different horizontally-adjusted positions. A horizontal adjustment device (sometimes called a "control" herein) controls horizontal adjustment, so that the armrest cap 57 cannot move rearwardly when the cap 57 is in an inwardly adjusted position where it can interferingly strike a back on the seating unit. In one form, the horizontal adjustment device includes a keyhole slot 60 in the cap 57 (FIGS. 7–9) and a configured protrusion 61 on the swing arm 58. The configured protrusion 61 has flat sides that are shaped to selectively non-rotatably slide along a long portion of the slot 60 (FIG. 7), but also includes arcuate end surfaces configured to rotate within the circular end of the keyhole slot 60 when positioned in the circular end of the keyhole slot 60 (FIGS. 8–9). By this arrangement, adjustment of the armrest 50 is controlled and prevented from striking the chair back 63 in location 64 (FIG. 1) as discussed below. A dampener 62 is attached to the swing arm 59 (FIG. 7) and frictionally engages a surface along the slot 60 to provide a smooth dampened motion having an elegant feel to a seated user during adjustment.

The support stalk 51 (FIG. 5) is L-shaped and includes a first end section 65 configured to matably engage and be attached under the chair's seat 66 (FIG. 1), such as to the chair's underseat control housing. The support stalk 51 further includes an upright vertical portion 67 and an intermediate portion 68 joining the first end section 65 and the vertical portion 67. The intermediate portion 68 forms an upwardly-facing curve that forms a concavity extending slightly below the end section 65 so that a bottom of the housing 53 can extend into the concavity. This allows the armrest subassembly 52 to be adjusted to a lower position than if the intermediate portion 68 extended linearly horizontally from the end section 65.

The vertical portion 67 of the stalk 51 is tubular, and includes upwardly-facing structure for receiving and attaching the nut 55. Specifically, the illustrated stalk 51 includes a pair of apertured bosses facing upwardly, and the nut 55 includes a tube section 69 that fits into the top of the stalk 51. The nut 55 includes apertured flanges 70 for receiving screws 71. The screws 71 are extended through the apertured flanges 70 and threaded into the apertured bosses in the stalk 51. The nut 55 includes a hole 72 with threads that extend through the nut 55 (including through the tube section 69). The threads have a high lead angle, such that one rotation of the threaded shaft 54 causes about a one-inch vertical movement of the armrest subassembly 52. Further, the lead angle of the threads is sufficient such that the threaded shaft 54 will rotate upon vertical pressure from a seated user. The threads may or may not be sufficient in angle such that the armrest subassembly 52 will not drop by its own weight.

The vertical portion 67 of the stalk 51 (FIG. 5) includes a pair of ring-shaped recesses 75 and 76, the upper recess 75 being formed at a top of the stalk 51 near the nut 55, and the lower recess 76 being formed several centimeters below the upper recess 75. C-shaped bearing rings 77 and 78 are resilient and shaped to snap-fit matingly into the ring-shaped recesses 75 and 76. The vertical spacing of the bearing rings 77, 78 and of the recesses 75, 76 is based on functional design criteria of the armrest. An increased spacing results in greater stability and lower torque stress on the bearing rings 77, 78, but it also limits the vertical adjustment stroke. A reduced spacing results in a greater vertical adjustment stroke, but can cause increased wear on the bearing rings 77 and 78, and also can reduce stability. It is noted that the illustrated bearing rings 77 and 78 are made of a low friction bearing material, and include enlarged pad areas 79 for providing increased support at critical areas on the bearing rings 77 and 78.

The armrest cap 57 (FIG. 5) includes a lower arm cap member 81 and an upper arm cap member 82. The upper arm cap member 82 includes a down-facing plate carrier (not specifically shown), foam on the plate member, and a skin covering for aesthetics. It is contemplated that the upper arm cap member 82 can be any number of different designs and configurations. The plate carrier of the upper arm cap member 82 includes apertured bosses, and the lower arm cap member 81 includes apertured flanges that align with the apertured bosses. Screws 83 extend through the apertured flanges on the lower arm cap member 81 and threadably into the apertured bosses on the upper arm cap member 82 to fix the cap members 81 and 82 together.

The housing 53 (FIG. 5) of armrest subassembly 52 includes an outwardly flared top section 86 and a tubular lower section 87. The tubular lower section 87 has a cross section shaped to telescopingly engage the vertical portion 67 of the stalk 51, and includes inner surfaces that slidingly matingly engage the bearing rings 77 and 78 at least in the pad areas 79. It is noted that the illustrated cross-sectional shape of the tubular lower section 87 and mating vertical portion 67 of the stalk 51 are generally oval-shaped, but it is contemplated that a number of different cross-sectional shapes could be used satisfactorily.

A main mounting plate 90 (FIG. 5) is a rigid component attached atop the top section 86 of the housing 53. Specifically, the top section 86 includes a top lip and ledge 91 defining a shallow recess that is shaped to receive the mounting plate 90. The mounting plate 90 includes apertures 92 and the top section 86 includes apertured bosses 93 shaped to threadingly receive screws 94 to secure the plate 90 to housing 53. The arrangement is stable and the components 86 and 90 rigidify each other as an assembly. The mounting plate 90 can be stamped from sheet metal or formed by another structural material. First and second raised protruding stops 95 and 96 are formed in the mounting plate 90 for engaging and stopping inward and outward rotation of the swing arms 58, 59, respectively, as discussed below. A main bearing plate 98 is secured on the mounting plate 90. The main bearing plate 98 is relatively flat and includes hollow protrusions 99 and 100 that matingly receive the protruding stops 95 and 96, adapted to abut and limit rotation of the swing arms 58, 59. The main bearing plate 98 also includes pivot bosses 101 and 102 for rotatably supporting the swing arms 58 and 59, respectively.

In the illustrated arrangement, the swing arm 58 is positioned at a rear of the armrest, and swing arm 59 is in a front of the armrest. However, it is contemplated that the entire arrangement can be reversed. Concurrently, the keyhole 60 would be moved to be at an opposite (front) end of the armrest to engage the protrusion 61 on the swing arm 58 at the front.

The illustrated swing arms 58 and 59 (FIG. 5) include an aperture 103 and 104, respectively, that rotatingly engage the associated pivot bosses 101 and 102 on the bearing plate 98. The apertures 103 and 104 (and pivot bosses 101 and 102) define stationary vertical axes of rotation relative to the housing 53. A second hole 105 and 106 is formed in the swing arms 58 and 59, respectively, for defining a second axis on each of the swing arms 58 and 59. Swing arm top bearings 107 and 108 are positioned on the swing arms 58 and 59, respectively. The lower cap member 81 includes the keyhole-shaped first slot 60 (with the circular portion of the keyhole-shaped slot being at a rear of the armrest 50) and further includes a linear second slot 109 aligned with the linear long portion 110 of the first slot 60. Shoulder screws 111 and 112 are extended from the top down through the apertures 103 and 104, respectively, in the swing arms 58 and 59, and threadably into the apertures 101 and 102, respectively, in the main bearing plate 98. In the illustrated arrangement, the screws 111 and 112 thread into the main mounting plate 90, though it is contemplated that nuts could be used on their bottom ends instead. By this arrangement, the swing arms 58 and 59 are rotatable on the bearing plate 98 and mounting plate 90 between an inward position against stop 95 and outward stop 96.

Shoulder rivets 120 and 121 are extended through the slots 60 and 109, through mating holes in the top bearings 107 and 108, respectively, and into secure engagement with the holes 105 and 106 in the swing arms 58 and 59, respectively. A locking nut 122 and washer 123 engage a top of the rivet 120, the washer 123 being large enough to slidingly retain the lower arm cap member 81 to the swing arm 58. A locking nut 124 and dampener holder 125 engage a top of the rivet 121, the holder 125 being large enough to slidingly retain the lower arm cap member 81 to the swing arm 59.

The rear swing arm bearing 107 (FIG. 5) includes the protrusion 61 that rides within the keyhole-shaped slot 60. The protrusion 61 (FIG. 8) includes opposing flat side surfaces 130 and 131 defining a dimension about equal to a width of the long portion 110 of the slot 60. By this arrangement, the protrusion 61 is adapted to slide along the long portion 110 (see FIG. 7). The protrusion 61 (FIG. 8) also includes radiused end surfaces 132 and 133 shaped to rotatingly engage the circular portion 134 of the slot 60. (See FIG. 9.) As will be understood by those skilled in the art, this provides an advantageous arrangement since the armrest cap 57 can be adjusted horizontally in a fore/aft direction (i.e., a longitudinal direction) (compare FIGS. 7–8) or can be adjusted horizontally translationally/laterally (compare FIGS. 8–9). Also, it is clear from the FIG. 9 (and FIG. 5) that the armrest cap 57 can be adjusted horizontally rotationally/laterally by rotating one of the swing arms 58 and 59 more than the other swing arm 58 and 59.

It will be understood by those skilled in the art that the present arrangement controls adjustment movement. Specifically, the arrangement "control" prevents rotation at certain times and positions, and prevents lateral movement at certain times and armrest positions, but allows longitudinal adjustment movement when the armrest cap 57 is moved rearward of its forwardmost adjusted position. Restated, when the protrusion 61 is positioned in the long portion 110 of the slot 60, it prevents the swing arm 58 from rotating and in turn also prevents the second swing arm 59 from rotating due to close engagement of its side surfaces 130 and 131 with marginal material forming the long portion 110 of the slot 60. Also, it will be understood by those skilled in the art that the present "control" arrangement prevents longitudinal adjustment, but allows rotation and/or lateral adjustment when the armrest cap 57 is rotated when in its forwardmost adjusted position where the protrusion 61 is rotated partially in the circular portion 134 of the slot 60. Restated, when the protrusion 61 is positioned and rotated in the circular portion 134 of the slot 60, it prevents the swing arm 58 from moving longitudinally. When the protrusion 61 is in the circular portion 134 and is aligned with the long portion 110, a seated user can choose to move the armrest cap 57 laterally with a translating motion (see FIG. 9), or can rotate one swing arm 58 and 59 more than the other, (thus causing an angular lateral adjustment movement), or can move the armrest cap 57 longitudinally.

It is noted that the illustrated protrusion 61 includes an angled flat surface 135 that is at an angle to the flat side surface 130. This helps direct or "funnel" the arm cap 57 angularly into perfect alignment with the long portion 110 of the slot 60 during the first part of a rearward longitudinal adjustment motion. In other words, it helps align the arm cap 57 so that even if the cap 57 (i.e., the protrusion 61) is not perfectly angularly aligned with the longitudinal long portion 110 of the slot 60, the seated user is still able to quickly and easily move the armrest to a position sufficiently centered and aligned so that the seated user can then fully adjust the arm cap 57 longitudinally in a rearward linear direction.

A swing arm cover 140 (FIG. 5) is positioned under the cap 57 and on the swing arms 58 and 59 to cover the swing arms 58 and 59 sufficiently for aesthetics and to prevent inadvertent access to the areas in-between and around the swing arms 58 and 59. The swing arm cover 140 includes a horizontal panel portion 141 and an outer down lip 142. A screw extends through a hole 143 in horizontal panel portion 141 and into the stop 96. It is noted that the stop 96 can be eliminated if desired, and the screw can be used to form the stop. Alternatively, the swing arms 58 and 59 can be shaped to engage in their outermost laterally-adjusted positions.

The lower arm cap member 81 (FIG. 5) is configured to support the longitudinal and lateral horizontal movements, as described above. It is also configured to operably support the dampener 62 and dampener holder 125, as follows. The lower arm cap member 81 includes a bottom cap plate 150 that is generally flat and that has the slots 60 and 109 formed therein. A perimeter wall 151 extends around the bottom cap plate 150 and defines a cavity within which several components are positioned, such as the nut 122 and the dampener holder 125. Reinforcement ribs 152 and 153 are added as required for stiffness and structural integrity of the component 81 and for function as required. For example, the reinforcement ribs 153 are positioned along an edge of the plate 150 and provide torsional resistance to side loading that may occur when the arm cap 57 is adjusted to a most inboard position where the least amount of support from the swing arms 58 and 59 is provided.

Figure 6:
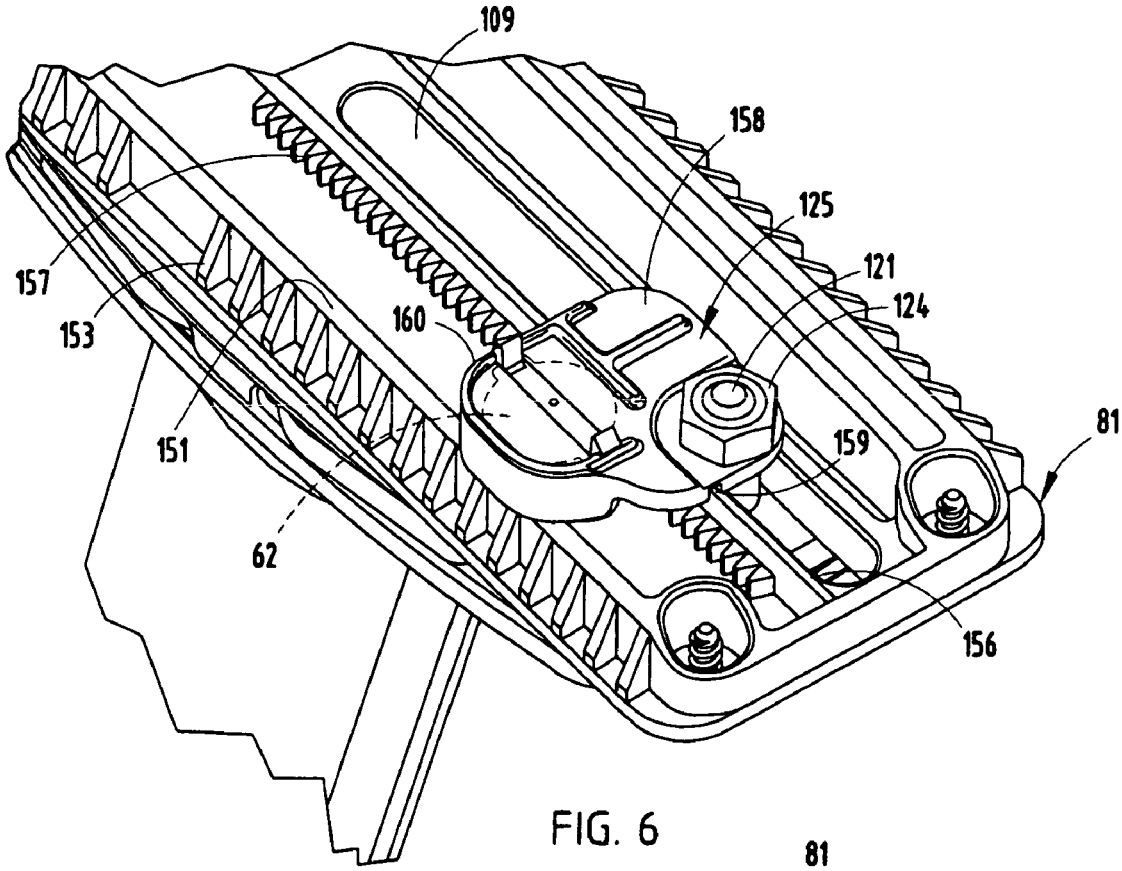
FIG. 6 is a top fragmentary perspective view of a rear portion of FIG. 3.
Figure 7:
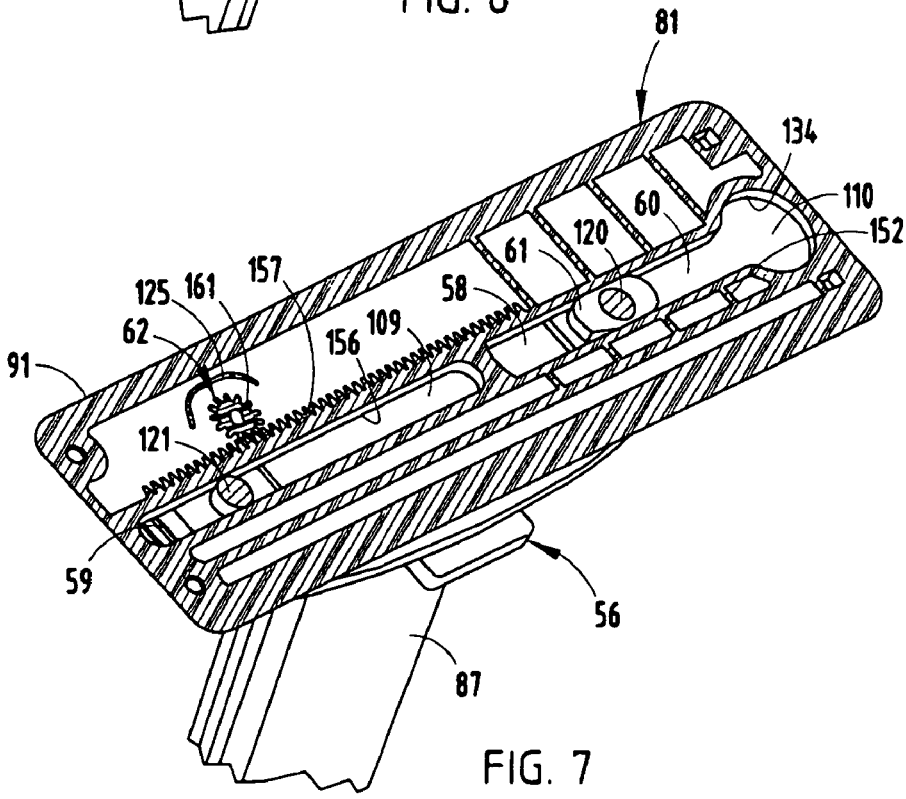
FIG. 7 is cross-sectional view taken along the line VII—VII in FIG. 3, the top armrest component being shown in a longitudinally-adjusted mid-position between its forward and rearward positions.
Figure 8:
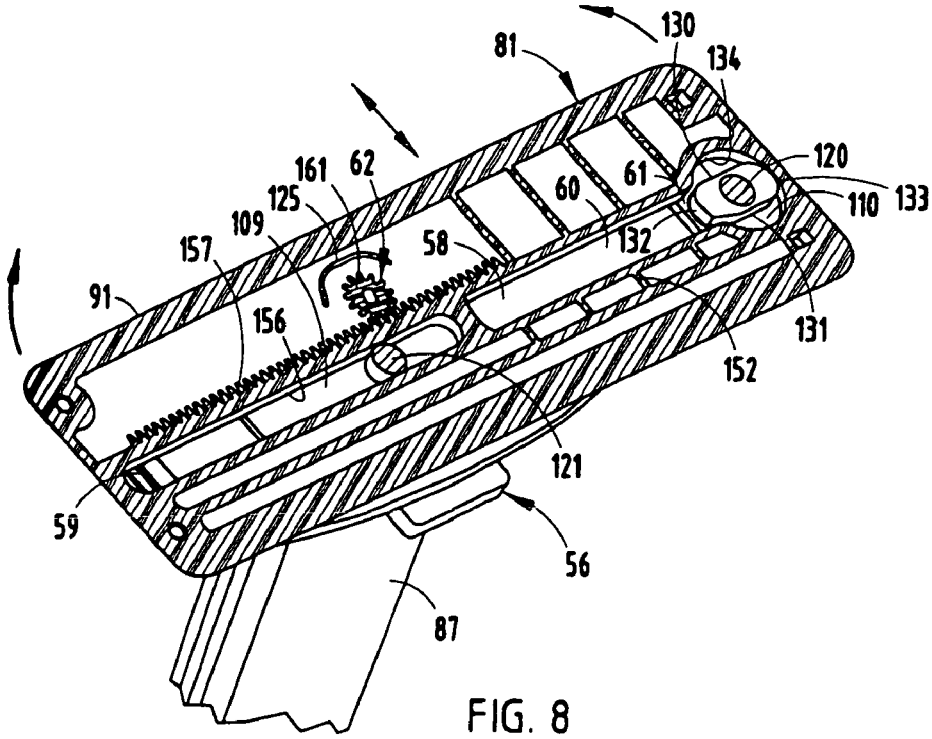
FIG. 8 is a view similar to FIG. 7, the top armrest component being shown in a forward position in a forwardly aligned position where it can be adjusted longitudinally/rearwardly or rotatingly/angularly.
Figure 9:
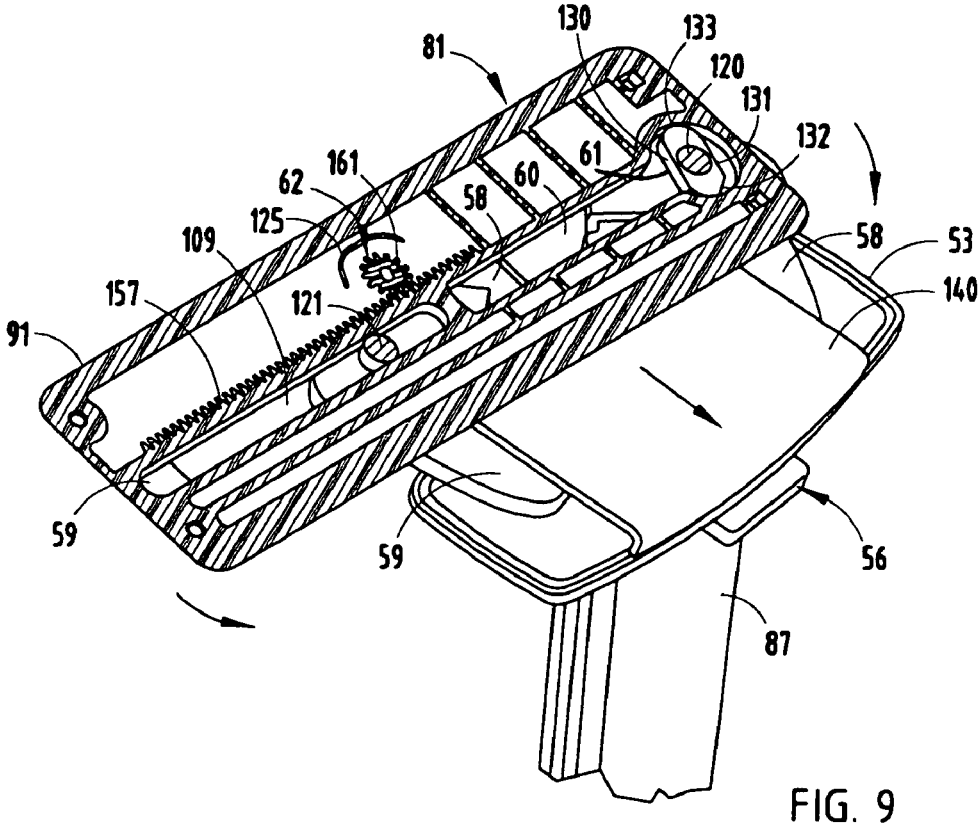
FIG. 9 is a view similar to FIG. 8, but adjusted translationally/laterally.

Several significant details of the bottom cap plate 150 are shown in FIGS. 7–9. The FIGS. 7–9 are cross-sectional views where the cross-sectional plane is taken just above the bottom cap plate 150. The cap plate 150 includes an inner wall 156 that extends along the slot 109, the wall 156 including a surface forming part of the slot 109. A row of teeth 157 (also called a "rack" herein) are formed on an opposite side of the inner wall 156. The row of teeth 157 face in an inboard direction on the lower arm cap member 81. The dampener holder 125 (FIG. 6) includes a box-like housing 158 with a hole therein that receives the rivet 121. The nut 124 engages the rivet 121 to hold the holder housing 158 in place on the cap member 81. The housing 158 includes a recess 159 that slidingly engages a top of the inner wall 156, forming a secure non-binding sliding arrangement. A lateral portion 160 of the housing 158 fits between the inner wall 156 and the perimeter wall 151. The dampener 62 is attached to the lateral portion 160 of the housing 158 in a location between the walls 151 and housing 158.

Dampeners are well known in the art such that a detailed description herein is not required. It is sufficient to note that the illustrated dampener 62 is a preassembled unit having a dampener chamber-forming member defining a cavity filled with a viscous material, such as silicone. The illustrated dampener 62 further includes a rotor with a first end positioned in the viscous material, and a second end extending from the chamber-forming member to an exterior position. The rotor has a gear 161 (FIG. 7) that is positioned on the second end to engage the row of teeth 157. By this arrangement, the dampener 62 stays with and is attached to the swing arm 59 by rivet 121, but the row of teeth 157 move with the armrest cap 57 since they are integrally formed on the lower cap member 81.

As the armrest cap 57 is moved longitudinally (see FIG. 7), the row of teeth 157 move relative to the gear 161 and cause the rotor to rotate. Since the rotational movement of the rotor is dampened by the viscous material within the dampener, the longitudinal movement is dampened. The result is a very uniform and smooth elegant feel to the seated user adjusting the armrest. By this same arrangement, if the arm cap 57 is adjusted laterally (either rotationally or translationally), the rotor moves relative to the swing arm 59 during the lateral adjustment. This again results in a very uniform and smooth elegant feel to the seated user adjusting the armrest. Dampeners such as dampener 62 are not inexpensive. Accordingly, this arrangement which allows a single dampener 62 to dampen both lateral (rotation and/or translational) movement as well as longitudinal movement is considered a significant benefit.

Figure 10:
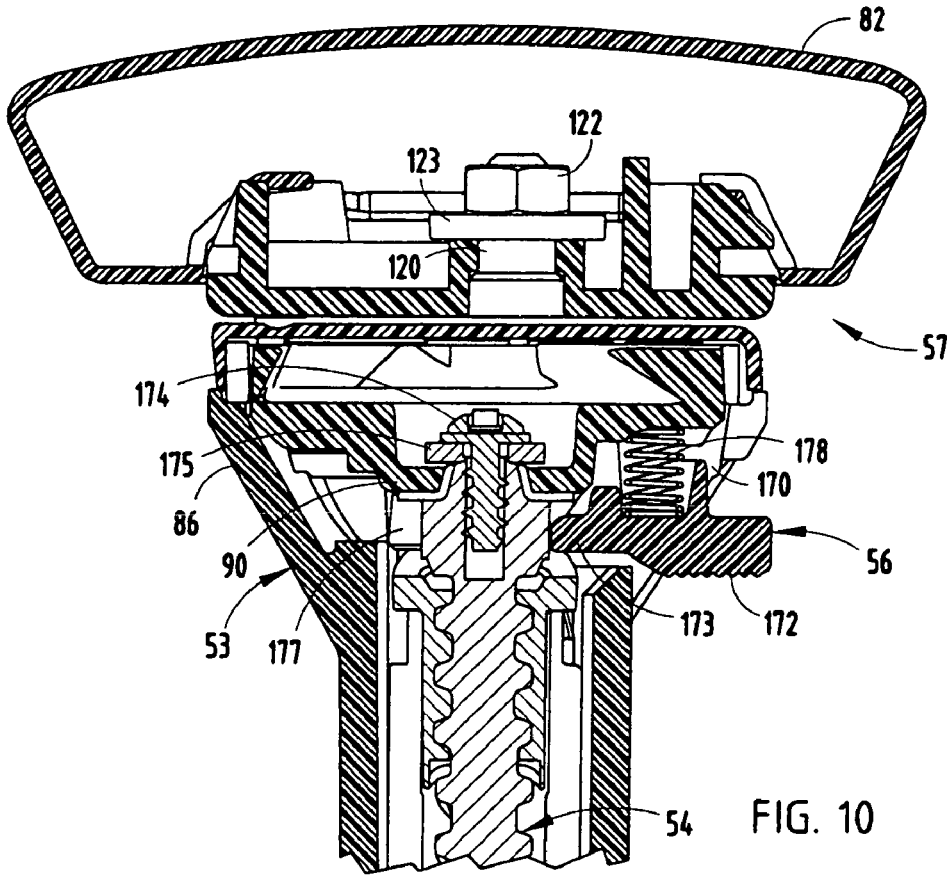
FIG. 10 is a vertical cross section taken along lines X—X through FIG. 2, showing a vertical height adjustment system including a trigger for releasing the same.
Figure 11:
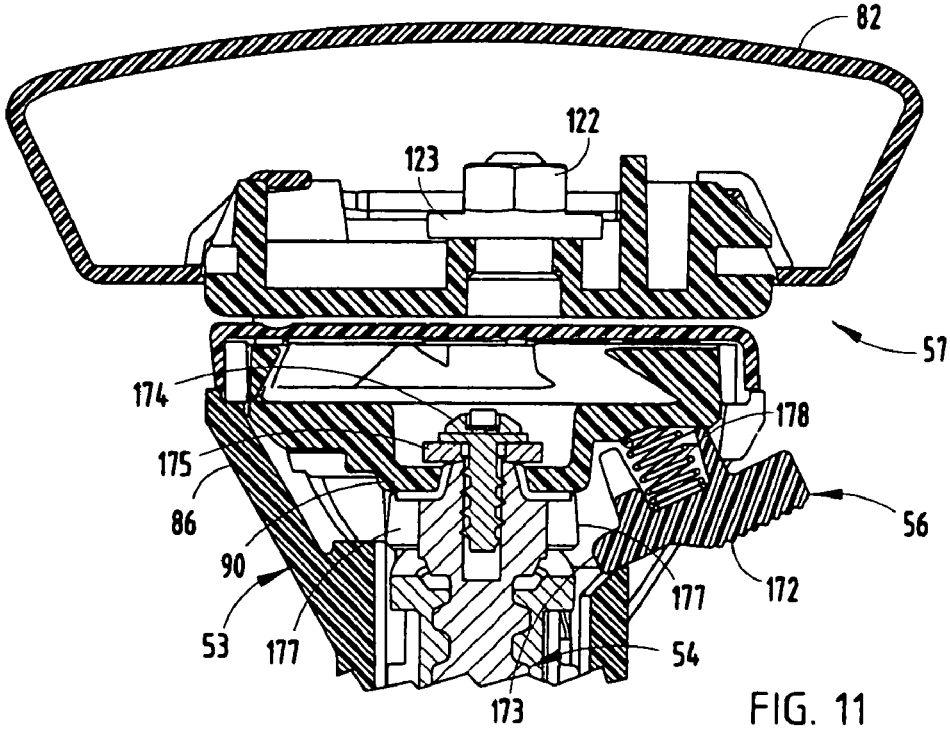
FIG. 11 is a view similar to FIG. 10, but with the trigger moved to an unlocked position.

Returning to the structure permitting vertical adjustment, there is provided a locking structure to fix the spiral threaded shaft 54 and selectively prevent its rotation. The top portion 86 of the housing 53 includes an aperture 170 (FIG. 10). The activation lever 56 (also called a "trigger" herein) includes a pair of aligned laterally extending protrusions 171 forming an axle that pivotally engages mating recesses formed in the wall of housing top portion 86 adjacent the aperture 170. An outer portion 172 of the lever 56 forms a handle adapted for a seated user to engage and depress. An inner portion of the lever 56 forms one or more locking teeth 173. A top of the rotatable shaft 54 includes an axial threaded hole. A screw 174 and washer 175 are supported in a depression in mounting plate 90, with the screw 174 extending through a hole in the mounting plate 90 into threaded engagement with the axial hole in the shaft 54. By this arrangement, the shaft 54 is rotatably supported by the mounting plate 90. A top of the shaft 54 has a configured shape that includes a series of radial teeth 177. The teeth 177 can be formed as an integral part of the shaft 54 or can be attached to a top of the shaft 54. A spring 178 biases the lever 56 (FIG. 10) to a normally engaged position, where the locking tooth 173 engages the radial teeth 177 to prevent rotation of the shaft 54. This fixes the vertical height of the armrest subassembly 52 on the stalk 51. When the lever 56 is depressed (FIG. 11), the lever 56 is rotated to disengage the locking tooth 173, thus permitting the shaft 54 to rotate and thus allowing vertical height adjustment of the armrest subassembly 52 relative to the stalk 51.

Figure 12:
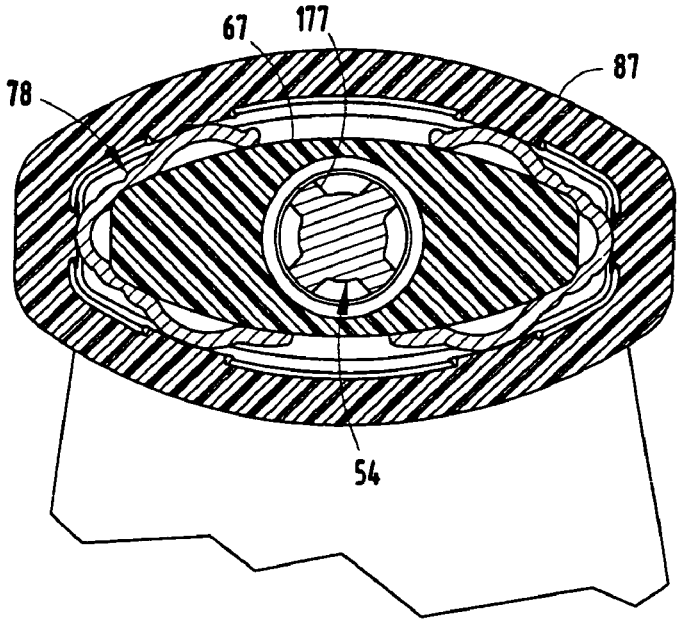
FIG. 12 is a horizontal cross section through FIG. 3.
Figure 13:
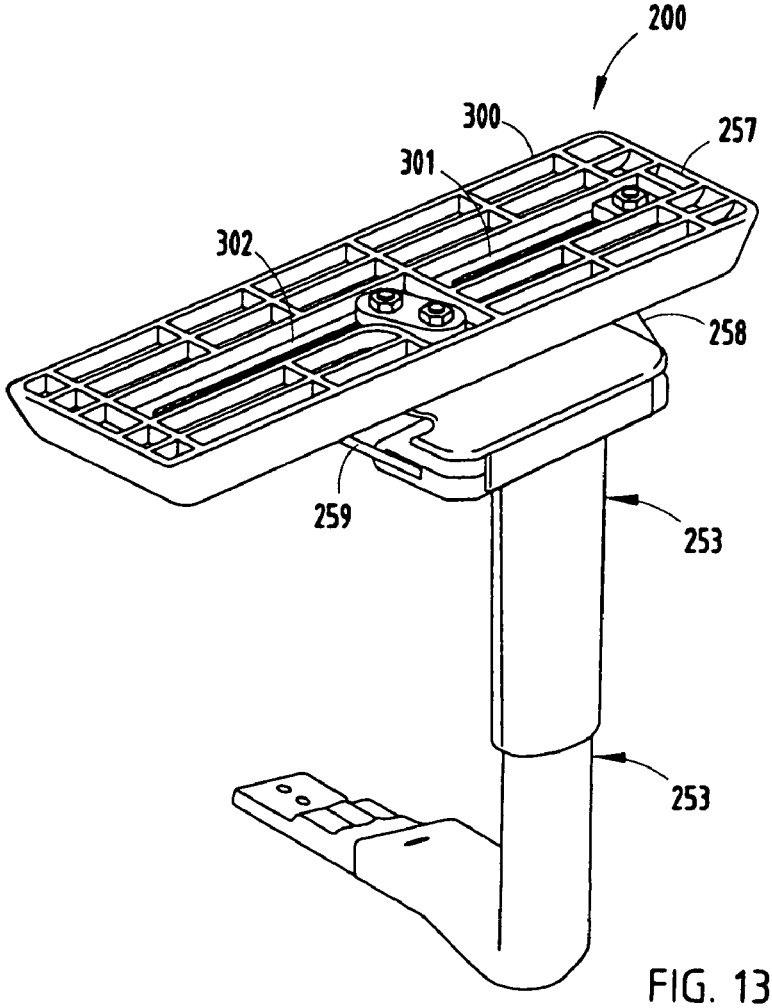
FIG. 13 is a modified armrest that is both longitudinally and laterally adjustable.
Figure 14:
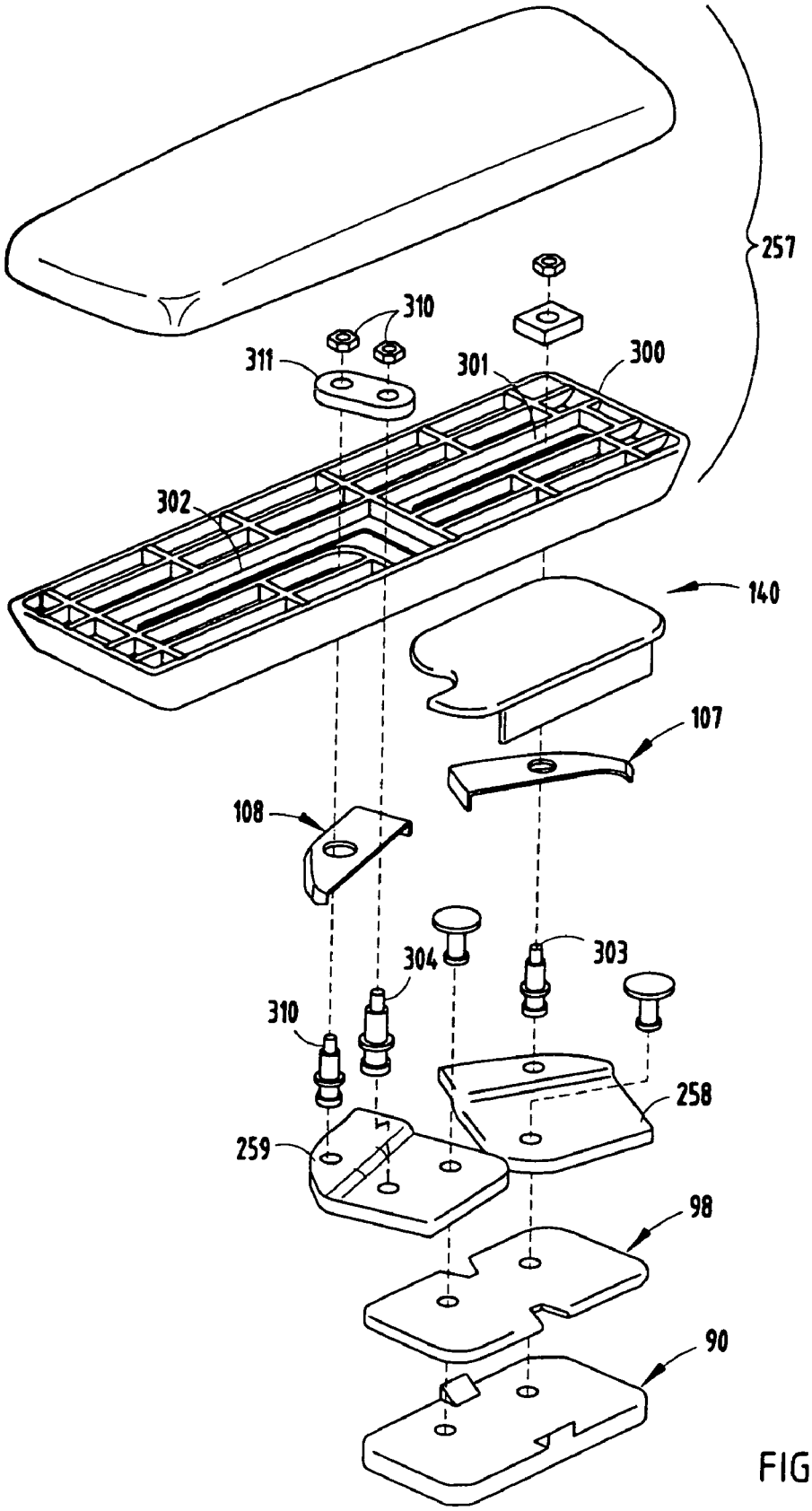
FIG. 14 is an exploded perspective view of FIG. 13.
Figure 15:
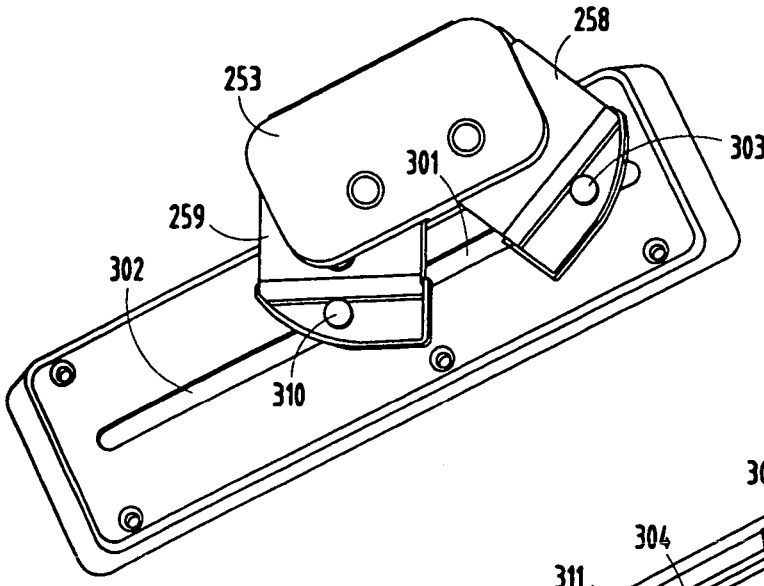
FIG. 15 is a bottom perspective view of FIG. 13, the armrest being laterally adjusted.
Figure 16:
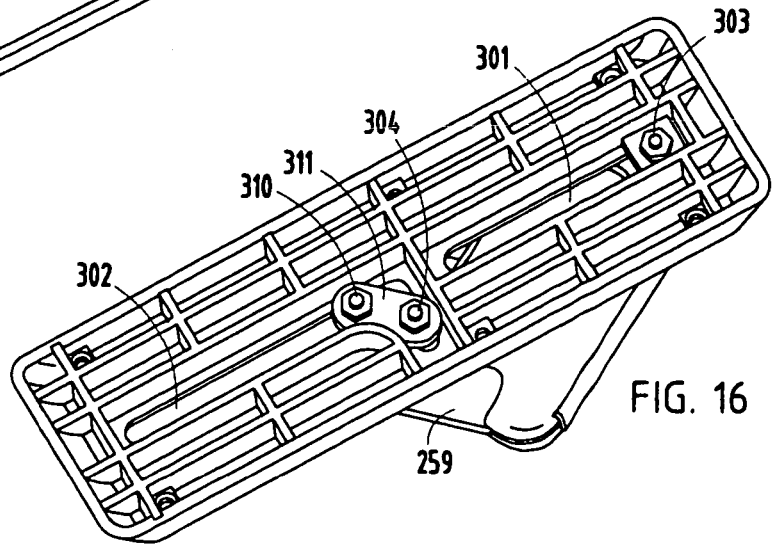
FIG. 16 is a top perspective view of FIG. 15, the armrest being rotationally adjusted.
Figure 17:
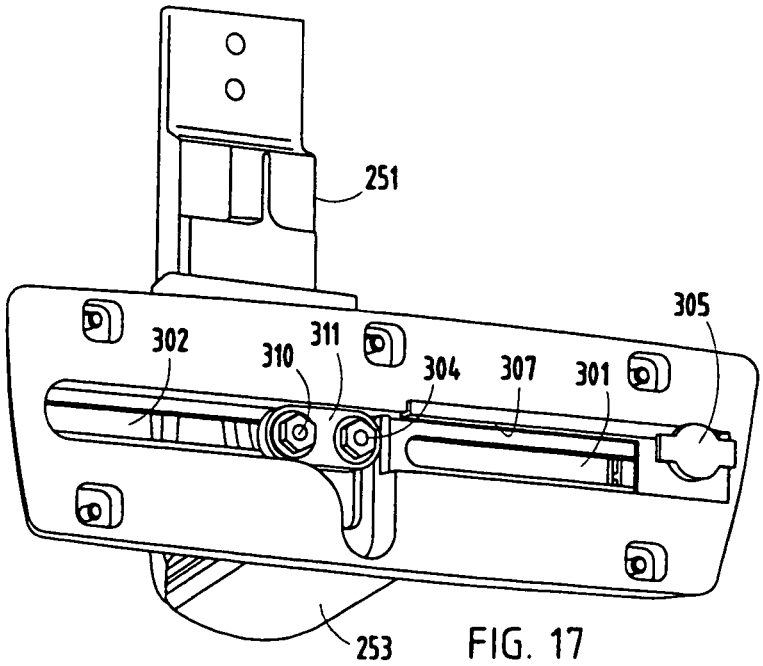
FIG. 17 is a top view similar to FIG. 16, but with the armrest being positioned at a forward end of adjustment, the top armrest component being ready for angular adjustment or longitudinal adjustment.

The pitch or angle of the threads on the shaft 54 is an important feature. The pitch can be such that it allows the armrest subassembly 52 to be moved upwardly or downwardly with moderate pressure, but so that the armrest subassembly 52 does not "fall" under its own weight. Alternatively, the pitch can be designed so that it will move downward under its own weight. This feature is affected substantially by material choice, lubricity of the interfacing materials and/or lubricants present, by armrest weight, by design criteria, and many other factors. In a preferred form, the thread pitch was such that one rotation of the shaft 54 caused a one-inch vertical movement of the armrest subassembly 52. Four threads were used. (See FIG. 12.) In the illustrated arrangement, about 4 to 8 radial teeth 177 were used, and a single locking tooth 173 was used. However, more or less teeth can be used, if desired. Hence, the armrest subassembly 52 could be adjusted to discrete positions that were about ¼ inch to ⅛ inch apart. The bearing rings 77 and 78 were made of acetal and the mating sliding components were made of a nylon material and/or coated with a lubricant.

The vertical adjustment locking structure included the spiral threaded shaft 54 (also called "adjustment screw") (FIG. 5), the rotational attachment of shaft 54 to mounting plate 90, the mating adjustment nut 55, the actuating lever trigger 56, and its engagement with a top toothed portion of the shaft 54. (FIG. 7.)

The horizontal adjustment movement includes moving the armrest cap 57 longitudinally along slots 60 and 109 (with the protrusion 61 aligned with a length of the slots) (FIG. 7). When the protrusion 61 is in the circular end 134 of the slot 60, the arm cap 57 can also be laterally angularly horizontally adjusted, including angular/lateral adjustment where one swing arm is rotated) (FIG. 8). Also when the protrusion 61 is in the circular end 134 of the slot 60, the arm cap 57 can be laterally translatingly adjusted, including translational lateral adjustment where both swing arms 58 and 59 are rotated (FIG. 8).

The horizontal adjustment movement of the armrest cap 57 is dampened in all directions by a single dampener 62 attached to the swing arm 59. Specifically, when the armrest cap 57 is moved longitudinally, the rotor of the dampener 62 rotates by engagement with the row of teeth along the slot 109. Also, when the armrest cap 57 is moved laterally (angularly or translationally) during a horizontal adjustment movement, the swing arm 59 rotates, causing the dampener rotor to undergo dampened rotation to permit the swing arm 59 to rotate. Thus, the angular and translational lateral movement is also dampened.

It is contemplated that a dampener could be used for dampening vertical motion of the arm. For example, the gear of the dampener could engage a gear on the threaded shaft (54). More broadly, the dampener could be mounted on the upper or lower arm components and engage a rack gear on the other component (such as on the support stalk 51).

A second armrest construction 200 (FIGS. 13–17) includes a cap 257 supported on an armrest support stalk 251, housing 253, and swing arms 258 and 259. The armrest support stalk 251, housing 253, and swing arms 258 and 259 are similar to the components 51, 53, 58 and 59 discussed in detail above, and a repetitious discussion is not necessary for an understand of this modification.

The cap 257 includes a lower cap member 300 having a linear slot 301 and an L-shaped slot 302. The swing arms 258 and 259 include rivets 303 and 304, respectively, that extend from the swing arms 258 and 259 through the slots 301 and 302, respectively. The dampener holder 305 is attached to the rivet 303. The dampener 306 is positioned within the holder 305, and includes a rotor with a downwardly extending gear. A row of teeth 307 are formed along the slot 301, and operate to rotate the rotor whenever the cap 257 is longitudinally adjusted. There is also dampening that occurs when the armrest cap 257 is rotated.

A second rivet 310 extends from the swing arm 259 into the L-shaped slot 302 at a location spaced from the first rivet 304. The spacing between the rivets 310 and 304 is about equal to a length of the short leg of the L-shaped slot 302. A link 311 is attached to a top of the two rivets 310 and 304. The presence of the two spaced-apart rivets 310 and 304 that ride along the slot 302 result in a movement similar to that disclosed above in regard to armrest 50. Specifically, when both rivets 310 and 304 are in the long linear leg of the L-shaped slot 302, they force the armrest cap 257 to be move linearly longitudinally. The armrest cap 257 cannot be angularly nor laterally adjusted when in this region. However, when the armrest cap 257 is at a forward end of the slots 301 and 302, the rivets 310 and 304 allow the armrest cap 257 to be angularly laterally adjusted (see FIGS. 16–17) and also translationally laterally adjusted (see FIG. 15). Notably, the inside concave surface 313 of the L-shaped slot 302 is radiused, and the link 311 is shaped to slide around this radiused surface 313. This helps a seated user align the armrest cap 257 with the longitudinal direction, and causes the armrest cap 257 to "funnel" into alignment even if there is a slight misalignment.

MODIFICATION

Figure 18:
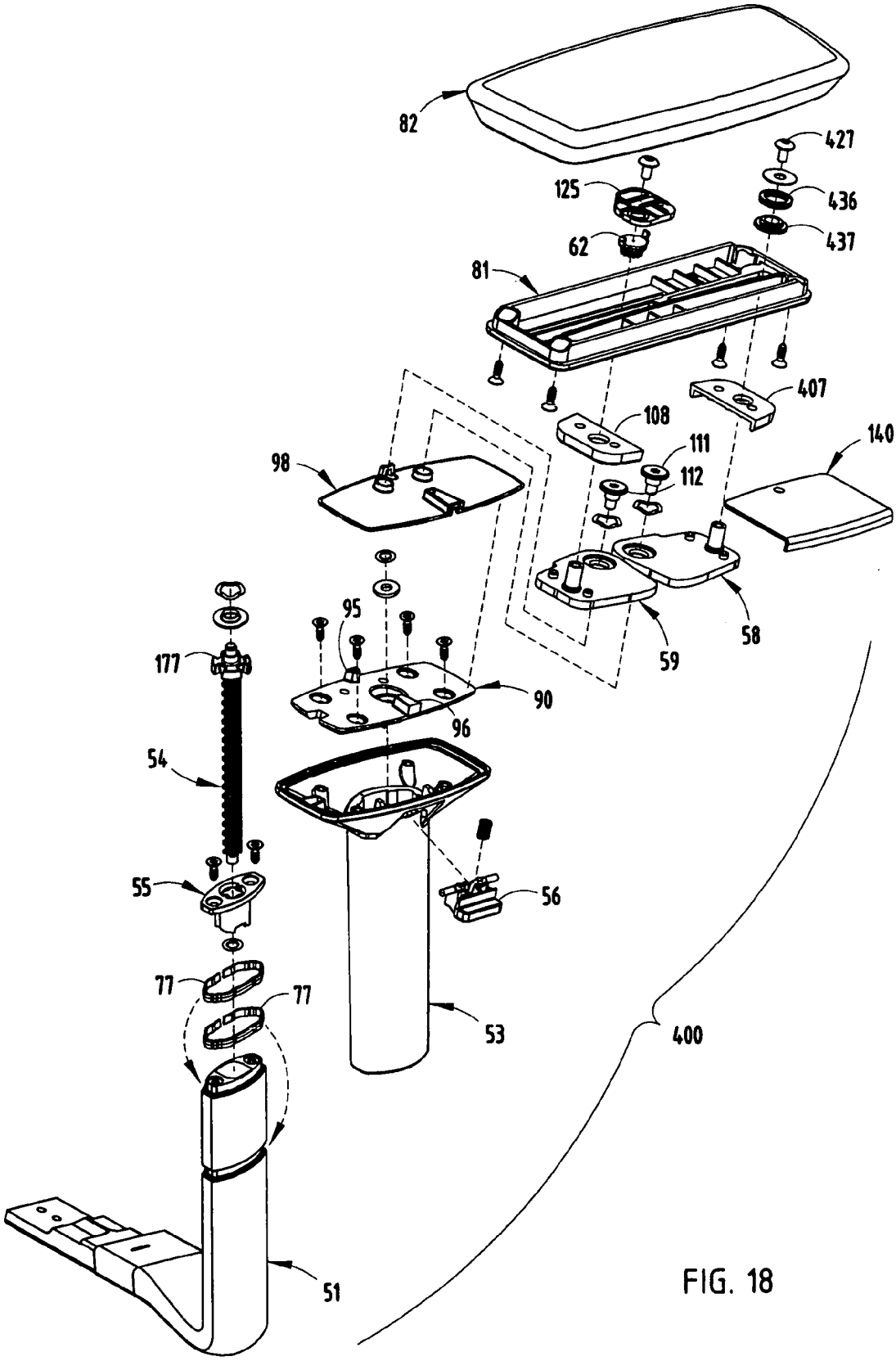
FIG. 18 is an exploded perspective view of a modified armrest similar to FIG. 5.
Figure 19:
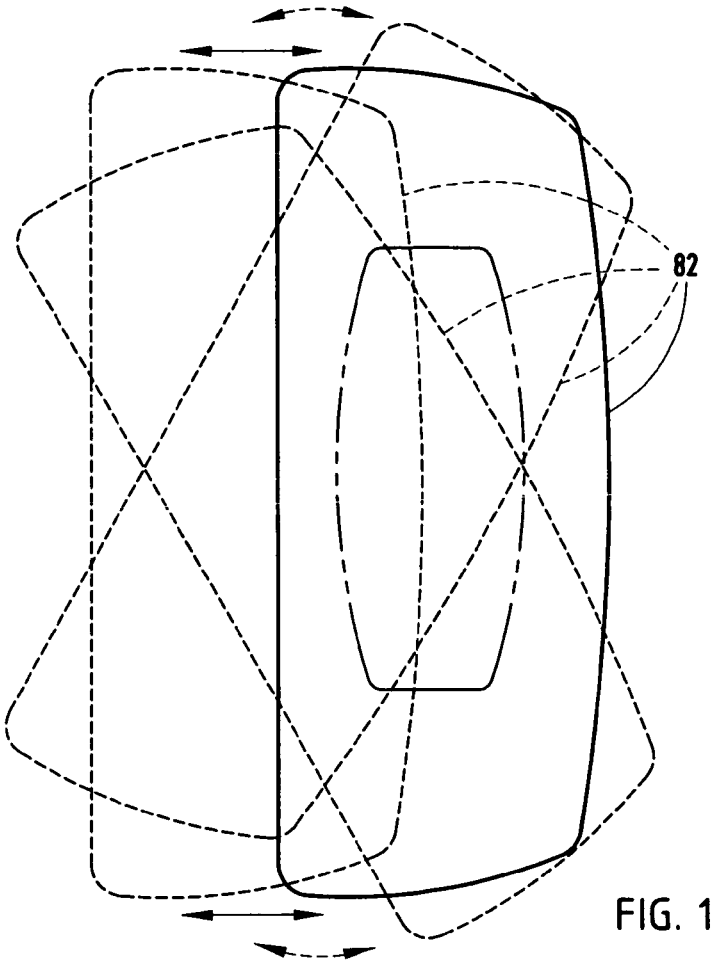
FIG. 19 is a top schematic view showing multiple adjusted positions of the armrest.

In the modified armrest 400 (FIG. 18), the structure in the armrest has been eliminated from the armrest 50 (FIG. 5) that prevents the armrest from rotating unless it is in a forward position. Specifically, the modified swing arm bearing 407 includes a flat top surface and does not include an elongated protrusion. (See the protrusion 61, FIG. 5, which has been eliminated). Therefore, the present armrest 400 can be adjusted in any direction (longitudinally, laterally/translationally, and angularly/rotationally) from any adjusted position.

Figure 20:
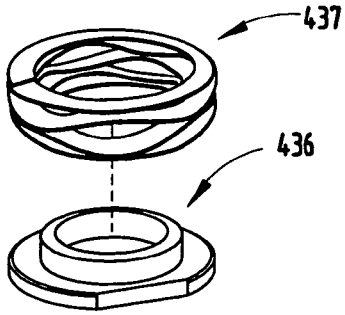
FIG. 20 is an enlarged perspective view of a multi-coil wave spring.
Figure 21:
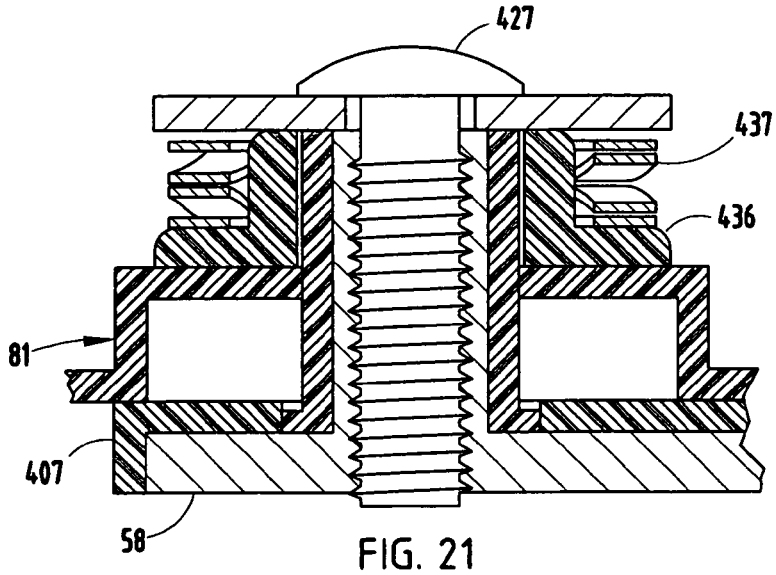
FIG. 21 is a cross section of the wave spring shown in the assembly of the armrest
Figure 22:
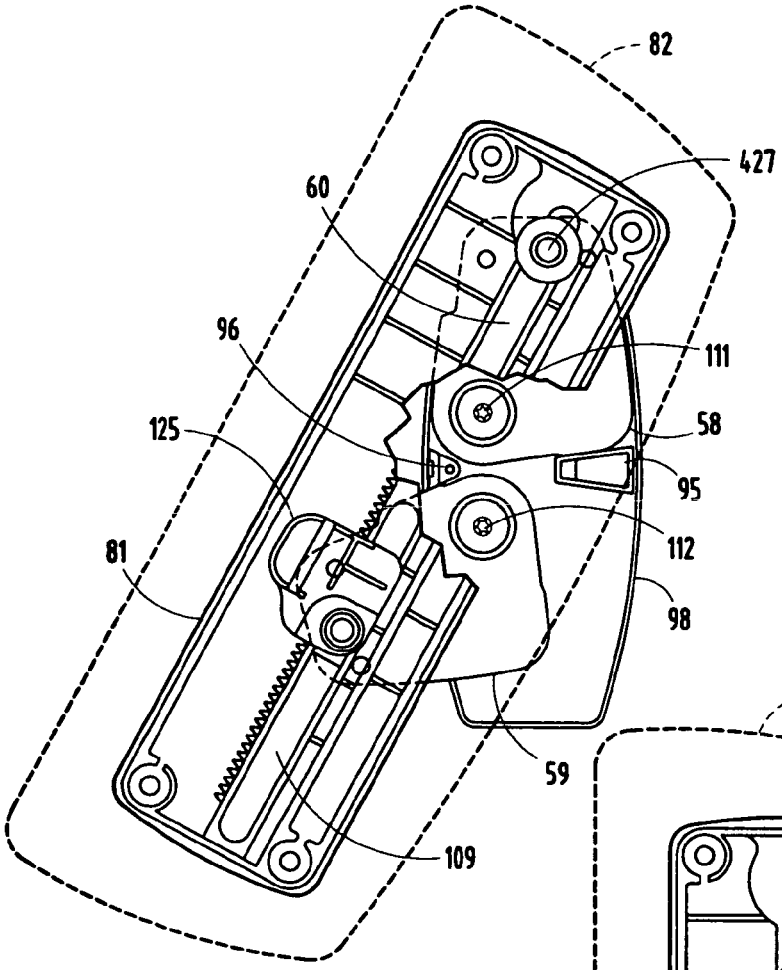
FIG. 22 is a perspective view showing one of the swing arms engaging the outer stop on the mounting plate for limiting outward rotation.
Figure 23:
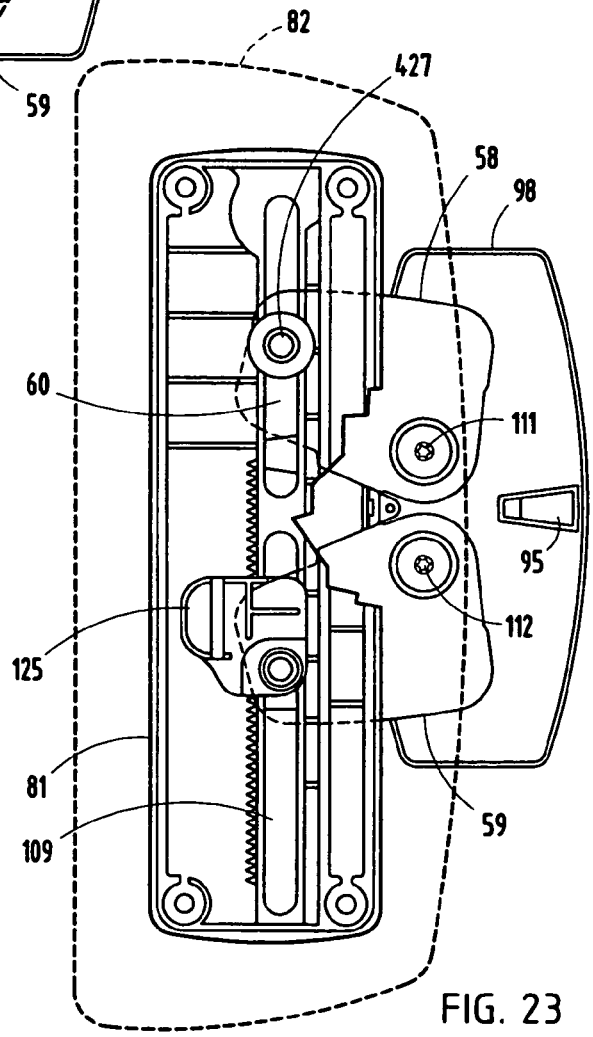
FIG. 23 is a perspective view showing both of the swing arms engaging the outer stop on the mounting plate for limiting outward rotation.

Also, a ring bearing 436 and a shim-end multi-coil wave compression spring 437 made by Smalley Spring Co. (see website www.smalley.com) has been included, mounted on an attachment bolt 427, in a way that increases friction during horizontal adjustment of the armrest. The multi-coil wave spring 437 (FIG. 20) is particularly compact and small in size. It includes a continuous spiral band having waves, with the crest of each successive ring abutting a trough of a next ring. The multi-coil wave spring 437 takes up about ½ to ⅓ of the axial space of a more traditional coil spring made from round wire. Yet multi-coil wave spring 437 provides a large vertical force to create sufficient friction to resist lateral/horizontal adjustment of the armrest.

Figure 5:
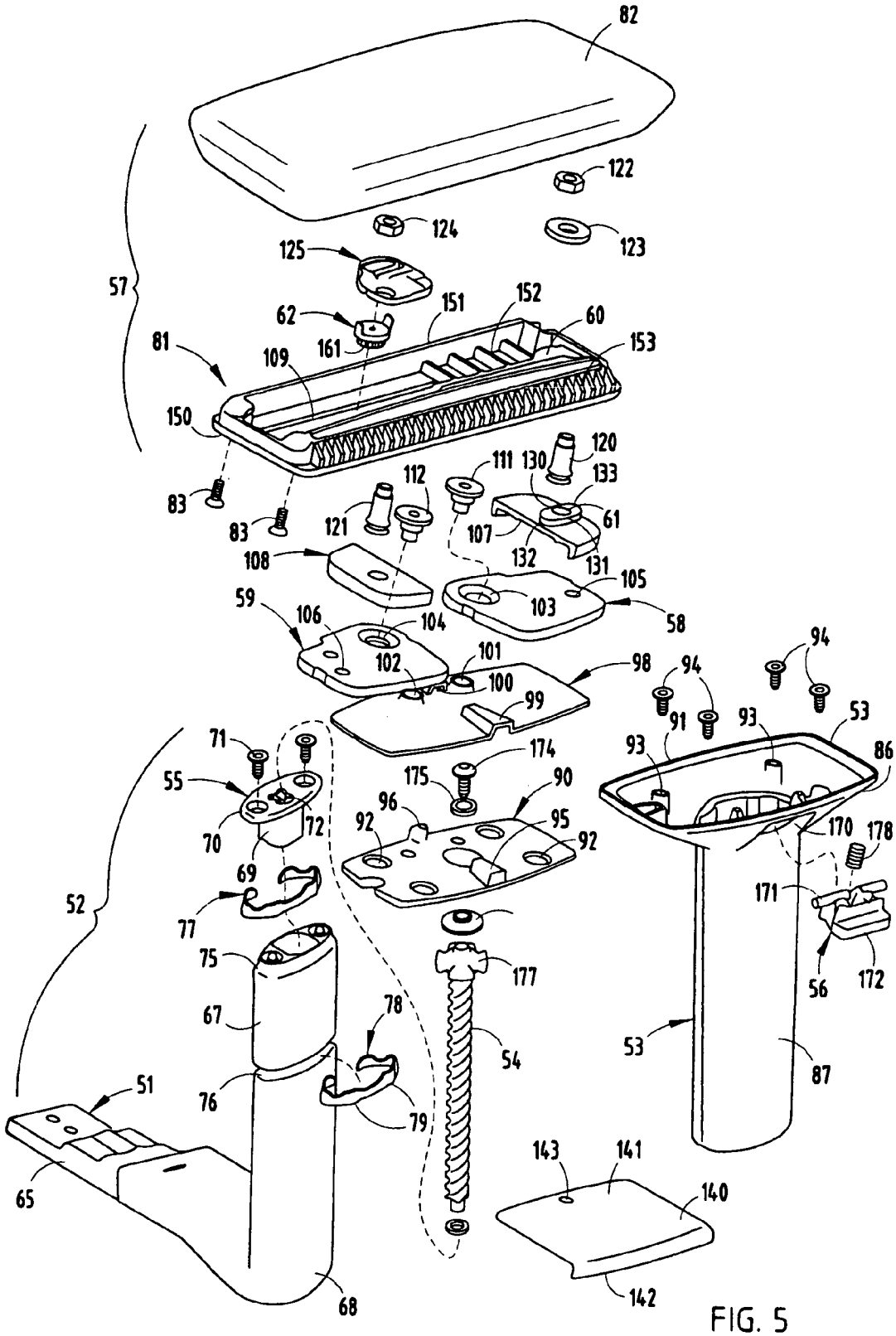
FIG. 5 is an exploded perspective view of FIG. 3.

The frictional force resisting lateral adjustment preferably is uniform and allows for a seated user to push and adjust the armrest laterally (without any detents). However, it is also desirable that the static frictional forces resisting lateral adjustment of the armrest be sufficient to resist unexpected sudden outward-sliding movement of the armrest when a seated user presses on the armrest to assist themselves in standing up. The spring 437 is mounted on a bolt 427 and two-step nylon bushing 436. The bolt and bushing replaces the shoulder rivet (120) (FIG. 5). This solution is much lower in cost, and is easier to assemble. The resulting force necessary for horizontal adjustment of the armrest cap 82 is at least about 4 pounds pressure, and more preferably over 5 pounds force, and most preferably is about 5 to 7½ pounds force in order to overcome frictional resistance and cause lateral adjustment of the armrest body/cap 57. Notably, this force increases if a person presses downwardly when standing up from a sitting position in the chair, since additional downward force results in proportionately greater frictional force. Notably, the speed of adjustment is also controlled by the dampener 62 and the way in which the swing arms drag under higher loads. Thus, application of any lateral force results in a smooth elegant adjustment motion, even if combined with large or small vertical forces on the armrest body/cap 57.

The present longitudinally/laterally/angularly adjustable armrest does not include any detents. Instead, it provides a continuous frictional resistance to movement . . . but does so with a very elegant and smooth feel. The frictional resistance is provided primarily by three mechanisms: 1) the compressed multi-coil wave spring 437 which presses the nylon bearing 436 against the cap member 81, 2) the sliding friction between the swing arms 407, 108 and the flat surfaces that they engage on the lower cap member 81 and the bearing plate 98 of the armrest support, and 3) the dampener (62). Notably, grease and lubricant are preferably not used on the abutting sliding surfaces since they might wipe away over time. Instead, components are made of appropriate mating materials, such as acetal and nylon, to provide a very smooth and elegant feel during horizontal sliding adjustment.

The mounting plate 90 includes stops 95 and 96. (See FIGS. 5 and 18.) The stops 95 and 96 are integrally formed with the mounting plate 90, and abuttingly engage the swing arms 58 and 59 such that they limit inward and outward rotation of the swing arms 58 and 59. The stops 95 and 96 are integrally formed such that they are robust and solid. Further, they are covered by an undulating mating ridges on the bearing 98, such that they provide noise-free positive action.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An armrest for a seating unit comprising:

an armrest stalk having a first vertical section defining a first non-circular tube;

an armrest assembly having a second vertical section defining a second non-circular tube and non-rotatably telescopingly engaging the first vertical section for vertical adjustment; and a height control including a spiral threaded shaft member supported in one of the first and second vertical sections, a mating nut member fixed to a top end of the other of the first and second vertical sections that operably engages the shaft member, and a trigger engaging the shaft member above the nut member; the threaded shaft member being rotatable upon a vertical force being placed on the armrest assembly, and the trigger being positioned to selectively engage the shaft member to prevent rotation after vertical adjustment to thus fix a selected height position.

2. The armrest defined in claim 1, wherein the spiral threaded shaft member is rotatably attached to the armrest assembly.

3. The armrest defined in claim 1, wherein the armrest assembly includes a housing that incorporates the second vertical section.

4. The armrest defined in claim 3, wherein the armrest assembly includes a mounting plate attached to the housing and that rotatably supports the threaded shaft member.

5. The armrest defined in claim 3, wherein a trigger is operably mounted to the housing for engaging the threaded shaft member.

6. The armrest defined in claim 5, wherein the threaded shaft member includes a configured top and the trigger engages the configured top.

7. The armrest defined in claim 6, wherein the trigger frictionally engages notches in the configured top.

8. The armrest defined in claim 7, wherein the configured top includes teeth.

9. The armrest defined in claim 3, wherein the trigger is a lever pivoted to the housing.

10. The armrest defined in claim 9, wherein the trigger includes integrally formed protrusions that rotatably engage mating surfaces on the housing.

11. The armrest defined in claim 1, wherein threads on the threaded shaft member cause about one rotation of the shaft member per one inch of vertical travel of the armrest assembly.

12. The armrest defined in claim 11, wherein there are four threads shown in a horizontal cross section taken through the shaft member.

13. The armrest defined in claim 11, wherein the configured top on the threaded shaft member has at least about 4 stop locations per one rotation of the threaded shaft member.

14. The armrest defined in claim 1, including bearing rings on the first vertical section of the stalk that slidingly engage the second vertical section of the armrest assembly.

15. The armrest defined in claim 14, wherein the trigger is pivoted to the second vertical section.

16. The armrest defined in claim 15, wherein the armrest assembly includes an armrest cap adjustably supported for horizontal adjustment on a top of the second vertical section.

17. In an armrest for a seating unit that includes an armrest stalk having a vertical section and an armrest component that vertically engages the vertical section for vertical adjustment, an improvement comprising:

a height control including a spiral threaded shaft member on one of the vertical section and the armrest component, a mating nut member on the other of the vertical section and the armrest component that operably engages the shaft member, and a trigger positioned to engage a configured top end of the shaft member above the nut member; the threaded shaft member being rotatable upon a vertical force being placed on the armrest component, and the trigger being positioned to selectively engage the configured top end to prevent further rotation of the shaft member after vertical adjustment to thus fix a selected height position.

18. The improvement defined in claim 17, wherein one of the vertical section and the armrest component is tubular and telescopingly engages the other of the vertical section and the armrest component.

19. An adjustable device comprising:

a stalk for supporting a device and having a first vertical section defining a first non-circular tube;

a subassembly having a second vertical section defining a second non-circular tube that non-rotatably slidingly engages the first vertical section for translational adjustment; and an adjustment control device including a spiral threaded shaft member with a configured top end in one of the first and second vertical sections, a mating member fixed to the other of the first and second vertical sections that operably engages the shaft member, and a trigger; the shaft member being rotatable upon a vertical force being placed on the subassembly, and the trigger being positioned to selectively engage the configured end above the mating member to prevent rotation after vertical adjustment to thus fix a selected height position.

20. The adjustable device defined in claim 19, wherein threads on the shaft member have a pitch causing about one rotation of the shaft per one inch of vertical travel of the subassembly.

21. The adjustable device defined in claim 19, wherein the thread of the shaft member include four threads in a horizontal cross section through the shaft member.

22. The adjustable device defined in claim 21, wherein the shaft member has a configured top defining at least 4 stop locations per one rotation of the shaft member.

23. The adjustable device defined in claim 22, including at least two bearing rings between the first and second vertical sections that support smooth sliding engagement.

* * * * *